US006796286B1

(12) United States Patent
Rasmussen

(10) Patent No.: US 6,796,286 B1
(45) Date of Patent: Sep. 28, 2004

(54) PISTON ENGINE

(76) Inventor: Gunnar Vestergaard Rasmussen, Vængemosevej 13, Skaarup (DK), 5881

( * ) Notice: Subject to any disclaimer, the term of this patent is extended or adjusted under 35 U.S.C. 154(b) by 0 days.

(21) Appl. No.: 09/720,339

(22) PCT Filed: Jun. 4, 1999

(86) PCT No.: PCT/DK99/00298

§ 371 (c)(1),
(2), (4) Date: Dec. 22, 2000

(87) PCT Pub. No.: WO99/66181

PCT Pub. Date: Dec. 23, 1999

(30) Foreign Application Priority Data

Jun. 4, 1998 (DK) ..... 1998 00723

(51) Int. Cl.[7] ..... F02B 75/02
(52) U.S. Cl. ..... 123/318
(58) Field of Search ..... 123/316, 317, 123/318

(56) References Cited

U.S. PATENT DOCUMENTS

| | | | |
|---|---|---|---|
| 1,362,080 | A | 12/1920 | Chorlton |
| 2,381,832 | A | 8/1945 | Mansoff |
| 3,789,808 | A | 2/1974 | Richter |
| 3,955,544 | A | 5/1976 | Franke |
| 3,981,280 | A | 9/1976 | Franke |

FOREIGN PATENT DOCUMENTS

| | | |
|---|---|---|
| DE | 68106 | 7/1969 |
| DE | 2 223 608 | 11/1973 |
| DE | 27 56 794 | 6/1978 |
| DE | 2 308 127 | 1/1979 |
| FR | 2230226 | 12/1974 |

*Primary Examiner*—Noah P. Kamen
(74) *Attorney, Agent, or Firm*—James Creighton Wray; Meera P. Narasimhan

(57) ABSTRACT

A piston machine has at least one axially movable piston in a cylinder. At the top of the cylinder there is at least one intake valve and at least one exhaust valve. An injection port is provided in a cylinder wall between a lower and upper point of reversal of the piston. The air is suitably supplied from an air chamber between the cylinder wall and a lower narrowed part of the piston. For adjustment to the engine load, this air chamber may be connected with an extra air chamber suitably having an adjustable volume. Likewise, the engine may be provided with a rotary valve for supplying the air to the cylinder. This provides for a faster exhausting of the combustion gases and a better degree of filling of the cylinders.

22 Claims, 5 Drawing Sheets

PISTON ENGINE

BACKGROUND OF THE INVENTION

The present invention relates to a piston machine comprising a piston arranged in a cylinder in order to create a working chamber, and at least one pump chamber. The cylinder is provided with at least one suction port. A further injection port is arranged in the cylinder wall, connecting the pump chamber with a receiver.

The development of four-stroke automotive engines has been directed toward solutions that improve "breathing". As a result, even ordinary automobile engines contain 4 valves per cylinder. Recently systems of varying sophistication for controlling these engines, for example, as made in the VTEC-E engines from HONDA, have been developed.

Furthermore, the desire for higher power yield has resulted in the wide use of engines provided with turbo-supercharging.

Both trends in development have led to the use of more complicated and costly applications of components. This results in increased maintenance and repair costs.

However, the present invention is a simple solution that improves the normal air filling of four-stroke engines and makes supercharging possible on a regular scale.

Fundamentally, four-stroke engines can be supplied extra air by supplementing the amount of air sucked in through the traditional valve system with air supplied through ports. These ports are situated and made like the scavenging air ports in a two-stroke engine.

Because of the design of the ports, swirling in the combustion chamber can be influenced in a suitable manner and cooling of the piston tops, cylinder walls, and valves can be increased.

The air supply may be performed both at termination of each intake stroke and at the initiation of each exhaust stroke.

It is possible for the air supply to take place only at the termination of each intake stroke.

In the latter case, by using for example, a rotary valve rotating with an rpm 50% of the engine rpm, it is ensured that the air supply is only performed at the termination of the intake stroke.

Regardless of which solution is chosen, the timing for air supply must be relative to the ordinary valve system of the engine.

The indicated solutions may be realised in four-stroke engines, regardless of whether the piston drive forces are drawn by the use of traditional crank and connecting rod mechanisms, by the use of a new "double connecting rod mechanism" or by mechanisms that allow use of cylindrical piston rods reciprocated directly in the cylinder axis, as e.g. traditional crosshead engines, "crank loop" engines by FICHT GmbH & Co. KG, "twisting piston engines" by Teisen, and engines with the "I-yoke mechanism" developed by me.

A machine of the type mentioned by way of introduction is known from U.S. Pat. Nos. 3,789,808 and 1,362,080. None of these machines would be able to work in connection with one-cylinder machines. Furthermore, they are connected with drawbacks because they require a high-energy consumption and exhaust a high degree of pollution.

Moreover, they are only constructed to work in connection with motors. Accordingly, they are not able to function as piston machines, in which the work chamber is a pressure chamber in a compressor, without auxiliary equipment.

SUMMARY OF THE INVENTION

It is the object of the present invention to provide a new piston machine in which the above drawbacks are obviated and where it is possible to obtain a surplus charging of the working chamber, thereby making it possible to increase the effect thereof.

According to the present invention this object is obtained with a piston machine being characterised in that the machine only has one piston in each cylinder. The piston by reciprocation sucks in a charge/charges of which at least one is a supplementary aftercharge to the charge/charges supplied at the suction valve, a scavenging port and/or by other supply system/systems. This may be a supplement hereto of the same or other kind, supplied to the working chamber of the combined working and pumping piston itself by being blown through at least one injection port formed in its cylinder wall only for this port being placed close to the position taken by the top of piston when the piston is in its bottom dead point and at least in a position that it becomes completely exposed by the piston top. One or more injection ports, by one annular duct, are mutually connected to at least one preferably short, exhaust duct connecting them with the dead volume in the pump which compresses the supplementary aftercharge, which dead volume has been minimised. A differential pressure controlled check valve is disposed in exhaust duct close to the dead volume of the pump. A receiver is connected with the exhaust duct. The receivers used in the machine are designed so that their individual volumes may be increased or reduced by manual adjustment.

Due to the specific arrangement of the injection port in the cylinder wall a specific benefit is obtained. Thus there is achieved a piston controlled opening and closing of the injection port/ports. This determines the opening period, which is the basis for the period of injection, determined by the reciprocation speed of the piston during its passage of the injection port/ports, which injection period in connection with the charging pressure and the flow resistance arising from the feeding of the charge determines the extent of the aftercharge supplied to the working chamber in the injection period. The latter, therefore, being the cause of the preferred use of several injection ports.

In order to minimise the dead volume it is possible to establish the least possible clearance between the pump piston and the bottom part of the pump cylinder. This immediately causes an unsuitably high pressure on the charge in the pump. The charge is sucked in through a suitably short injection duct and is retained in the pump. The correct suction through the injection duct and retention of the charge in the pump is ensured by the use of the differential pressure controlled check valve.

The specific arrangement of the receiver, which has a dead volume, makes it possible to increase the dead volume of the pump and the volume of the duct connections extended to the injection ports. Moreover, the charge is compressed to the pressure that is most suitable for the application of the machine at the rpm and load preferred in use. This makes the machine advantageous for functioning in a range only slightly deviating from the rpm and the load at which it is intended to operate with the associated receiver. However, replacement is needed to adapt to another rpm and load range without an unsuitable increase of loss caused by throttling at the intake and loss by compression and injection occurring.

If the engine is subjected to varying rpm's and loads, as in an automotive engine, the machine is suitable for in the indicated design. It can perform aftercharging even from low rpm because it automatically adjusts to the load requirements it is subjected to. For example, it adjusts to variations such as speeding up or down, gearing up or down, or by external conditions, such as road inclinations, or head and tail wind, and if desired, it can compensate for centrifugal forces arising from road bends and other sudden steering turns. Furthermore, it is especially suitable for the purpose because the performed automatic regulating operations keep the mixing ratio of fuel and air supply suitable for immediate operating situations. This contributes to a r more even driving. Both conditions are important for achieving fuel savings and reducing exhaust pollution.

A piston machine has a charge collected and stored while the piston, by its reciprocating from its top dead point, toward its bottom dead point performs suction of the succeeding charge. The piston at the top of its stroke, initiates the exposing of the injection ports formed in the working cylinder, commencing injection of the charge previously compressed in the pump. Immediately after the check valve, the suction duct and the receiver determine the magnitude of the charge pressure that is associated with the dead volume of the pump. A likewise pressure differential controlled check valve is inserted in the inlet opening of the exhaust duct, immediately before a receiver associated with this duct. The receiver may be a combined receiver and pressure regulator retaining the compressed charge in the receiver until the exposure of the injection port/ports by the piston is injected to the working cylinder of the piston, which is a design, though requiring two check valves. This allows the piston to have a greater skirt diameter. In addition, because of the outward collaring of the piston, there is an increased lower diameter, making possible the use of a shorter connecting rod with greater freedom of deflection. As its form dictates, the annular pumping chamber is isolated from receiving lubrication. This is disadvantageous because an ordinary crank and connecting rod mechanism generates important lateral pressure on the piston. Also, increased piston weight makes the machine less suitable for applications with varying rpm.

The piston machine makes use of two different types of yoke mechanisms. Both mentioned mechanisms are advantageous because they ensure exact piston reciprocation in the cylinder axis. Performing sinusoidal (harmonic) piston strokes by evenly performed rotations is a simple way to make possible a complete (100%) outbalancing of all reciprocating masses in the cylinder axis. For the number of cylinders commonly used, also a complete (100%) outbalancing of the masses moved perpendicularly to the cylinder axis without the use of balancing mechanisms is desired. The "Scottish yoke mechanism" reduces the lateral pressure on the piston rod and the piston to 50% of that generated by a crank and connecting rod mechanism used for the same purpose. While the "I-yoke mechanism" operates without any generation of lateral pressure on the piston rod and the piston, the piston is isolated from the crank disc chamber and is not supplied with lubricating agent here from in a suitable manner. There is a need for relief of lateral pressure. This is because it both acts as a piston in the working and pump chamber under thermal load conditions. The working conditions are counteracted in the machine either by: adding a lubricating agent to the charge sucked into the charging pump by fog lubrication to the least practicable extent and which later, by combustion or by its presence in a compressed gas, is the least possible contaminating, or by quite simply using the elimination of the lateral pressure on the piston for completely avoiding lubrication, advantageously reducing the exhaust contamination, either by coating the piston rings, alternatively the piston and/or the cylinder with a film. For example, an amorphous diamond film developed by Sandia Laboratories, which can be coated at room temperature, is temperature resistant until 800 degrees Celsius, stress-free, safe against cracks, possesses a hardness corresponding to 90% of that of crystalline diamond, is resistant against most chemicals, and has a very low coefficient of friction. By using light, temperature resistant materials for the piston rings, the piston and/or the cylinder, may be provided with smooth surfaces, for example, ceramic type surfaces. The design and materials interact with automatically controlled, combined receivers and pressure regulators to make the machine capable of advantageous design in relation to its developed torque and yield, being used as a light and compact automotive four-stroke engine. Alternatively, it can be used as a single-stage compressor, made like a "boxer" engine with two piston sets per yoke disposed in the same cylinder axis, projecting to both sides of the common yoke. Furthermore, the supplementary aftercharge eliminates or limits the need more complicated and voluminous top valve constructions with increased numbers of valves per cylinder.

The charge in engines with direct fuel injection is atmospheric air. If necessary for lubrication of the isolated piston part, the atmospheric air may be supplied with a small oil fog content. In engines with indirect fuel supplies, a small oil fog content can be established by a fuel injection system associated with the supply duct of the aftercharge pump or a carburettor allowing the charge to be a suitable mixture of air, fuel and oil.

DETAILED DESCRIPTION OF PREFERRED EMBODIMENTS

Figure 1:
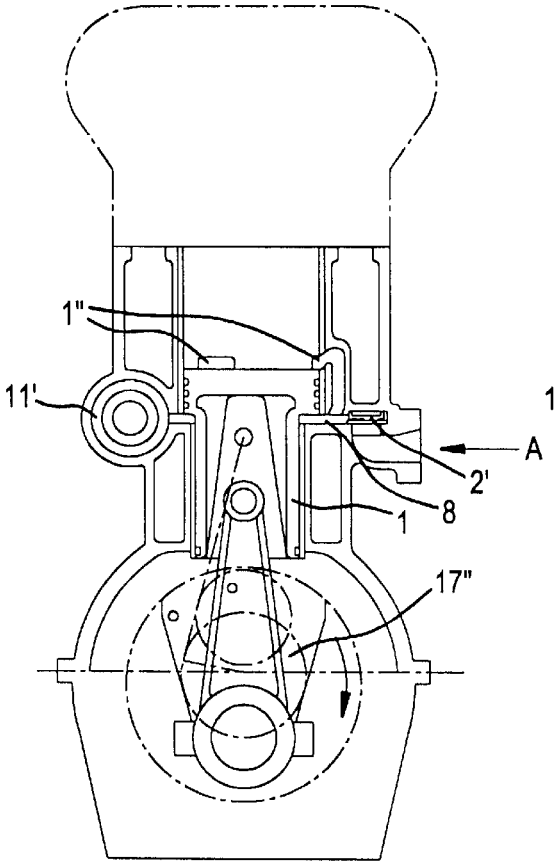
FIG. 1 PRIOR ART
FIG. 1 is a cross-section view of a conventional crankshaft mechanism.

FIG. 1 shows schematically how a four-stroke engine with a traditional crank-connecting rod mechanism 17', provided with the stepped piston 1, has been provided intake ports 1', which by supply ducts are connected with the annular chamber 8, formed under the relatively short piston top part because of the stepping of the piston.

The chamber 8 forms an air pump chamber, which through the check valve 2' and a supply duct by the movement of the piston from BDC to TDC can suck in fresh air shown by the supply arrow designated A.

The air pump chamber has to be given a small height in relation to the reversal of the piston in BDC because of the overall height of the engine. The compressed air under the piston top part will get an unsuitable high pressure if the air pump chamber is not associated with a receiver 11'.

The receiver may be provided with a regulating mechanism capable of regulating the volume of the receiver for receiving air, whereby it becomes capable of regulating the pressure of the air compressed in the air pump chamber.

Receivers of this kind may be a cylinder with a piston. When placed on a piston rod that may be moved in and out of the cylinder by a mechanism, the piston is capable of reducing or increasing the volume available for receiving the compressed air.

Volume regulated receivers interact with juxtaposed pump chambers. For example, in-line engines are made as one cylinder with one through-going piston rod which, passed through partitioning walls with stuffing box arrangements, carries a plurality of piston discs. One piston disc may be provided in each of the chambers into which the partitioning walls divide the cylinder. Each chamber in the cylinder is connected with a duct to their respective interacting pump chamber.

The connecting duct is disposed at one end of their chambers, which are kept clear of the piston regardless of the adjustment of the piston.

At the other end of the chamber, via borings through the cylinder wall, fresh air can penetrate in and out so that air cannot be compressed. This would otherwise inhibit the movement of the pistons by regulating in the direction toward that end of the receiver chamber.

Figure 4:
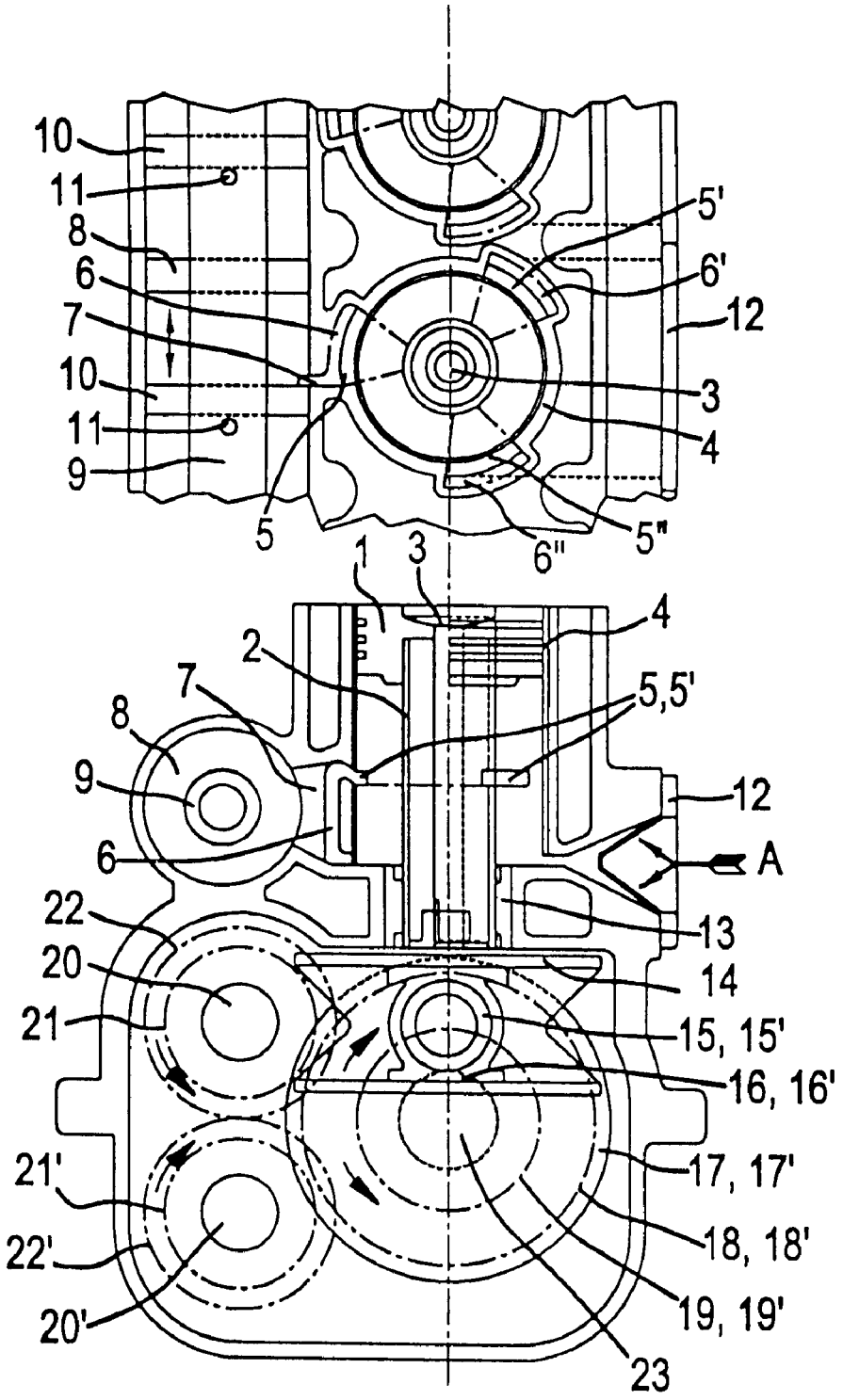
FIG. 4 is a cross-section view of the present crankshaft mechanism with an I-yoke.

A receiver of the latter type has been illustrated in the sketch FIG. 4.

Engines with plural cylinders may also have their air pump chambers connected with a receiver common to all chambers, e.g. of the type first mentioned with an adjustable volume, or to a receiver with a sufficiently large fixed volume.

A problem common to receivers with adjustable volume, and computer controlled regulating mechanisms with sensors registering the momentary rpm and load of the engines combined with the simultaneous speeding up of the engines, is that they slow hauling and economy of operation. At the same time the air-fuel ratio is optimally maintained for clean combustion. Less environmental impact is made by the release of exhaust gases.

The four-stroke engine shown in FIG. 1 is of the kind receiving extra air supply both at the end of each intake stroke and in the beginning of each exhaust stroke. If such an engine is provided with a rotary valve like the rotary valve 3" shown and placed in the same position as in FIG. 8*a*, and rotated with the same rpm as the crank mechanism of the engine, it is possible, either by giving the rotary valve a fixed twist or by providing it with a twisting or turning mechanism, either mechanically with centrifugally influenced blocks or computer controlled, which depending on the momentary rpm of the engine ensures that the supply of extra air is "delayed" and occurs at the most suitable time in relation to the closing of the intake valve and opening of the exhaust valve so that the supplied extra air amount is utilised optimally for charging or cooling, respectively.

Figure 2:
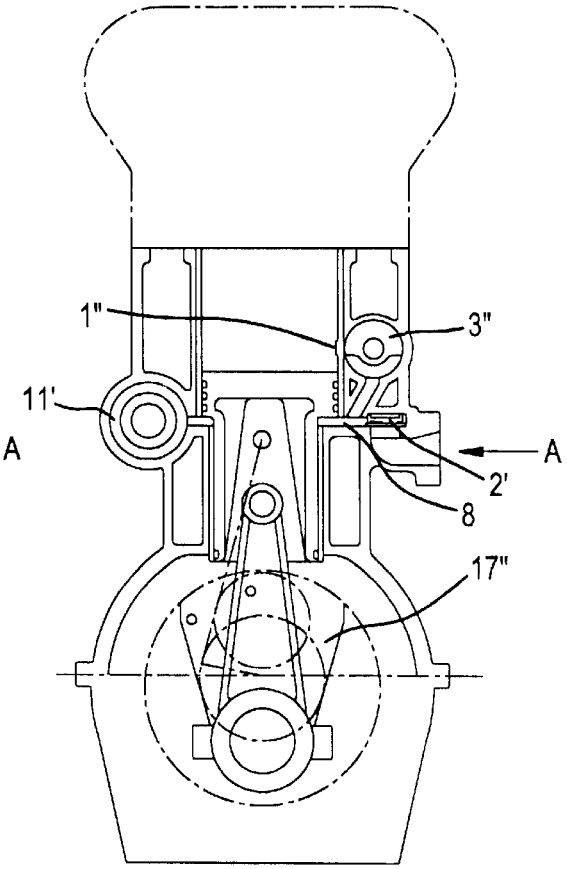
FIG. 2 PRIOR ART
FIG. 2 is a cross-section view of the crankshaft mechanism of FIG. 1 in operation.

The sketch FIG. 2, like FIG. 1, is an engine with traditional crank and connecting rod mechanism provided with a stepped piston. For the components forming a part of it, the sketch is numbered as FIG. 1.

If the rotary valve 3" is geared for rotating with an rpm which is 50% of the crank mechanism of the engine and is given an opening time starting at the termination of the intake stroke, the engine can be provided with a regular aftercharge. The rotary valve may of course be given the same mechanisms for "twisting" or "turning".

Since intake of air is performed at the passage of the check valve 2', this sucking in will chiefly occur only during the compression stroke. As the air sucked in during this stroke cools the piston skirt, cylinder wall, etc., the air is heated. The air is further heated during the subsequent working and exhaust strokes and during the intake stroke where the air is finally compressed before it is injected through the injection port 1".

Figure 3:
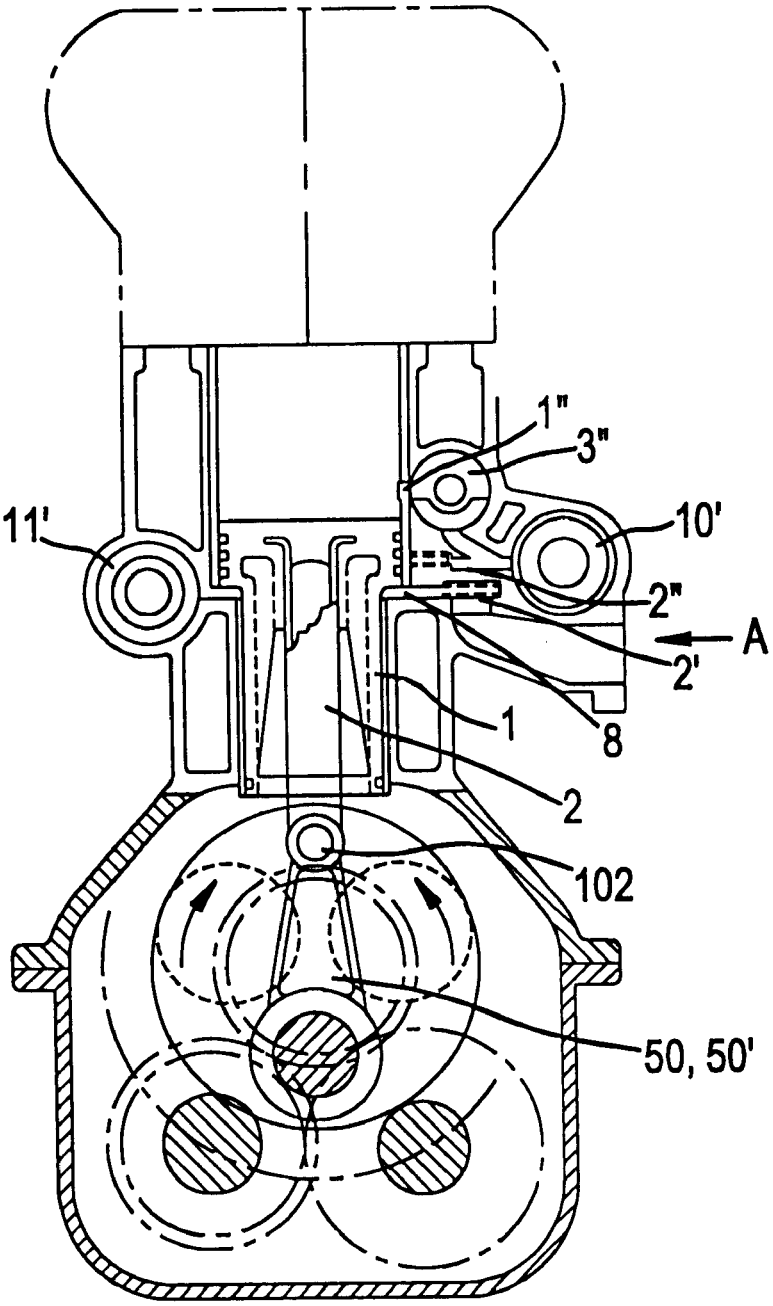
FIG. 3 is a cross-section view of the present crankshaft mechanism.

The sketch FIG. 3 illustrates a four-stroke engine with "double connecting rod mechanism" 50+50 described in Danish patent application no. 1278/96 with priority date Nov. 13 1996.

A "double connecting rod mechanism" causes relief of the lateral pressure on the stepped piston 1 at the same time as an absorption and transfer of the yielded drive forces in the piston axis and the occurring inertial forces to the piston pin 102. This results in a stepped piston with a hollow, cylindrical piston rod fixed, possibly moulded, in the piston, the piston rod carrying a fitting at the end receiving the piston pin.

Compared with the engine illustrated in FIG. 2, the engine in FIG. 3 is further provided with a check valve 2" and an extra receiver 10' that may have constant or adjustable volume and has ducts for supply and discharge.

Because of the supplement, the air sucked in during the compression stroke is forced through the check valve 2" to the receiver 10' by the subsequent compression during the combustion stroke. This transfer is caused because the pressure herein at the previous discharge of supplementary fresh air has been reduced to a lower pressure. At the subsequent exhaust stroke, depending on the relative momentary volumes of the receiver, a further amount of air can be sucked in and compressed during the intake stroke. Therefore, there can be a supplement to the amount of air already stored in the receiver 10' during the process. The simultaneous increased pressure in the receiver ensures that the extra air charge for the combustion chamber is increased.

In engines with rotary valves, this ensures that no short-circuiting takes place between combustion and pump chambers. This is true regardless of low piston height. Interaction with check valves inserted in the supply, for receivers intermediately storing fresh air, ensures that no untimely discharge from these combustion or pump chambers occur.

In engines with rotary valves the injection ports may be made high or placed higher over the piston top level at the reversal of the piston in BDC. This is because the injection ports are disposed closely to the external cylinder side of the rotary valve. Therefore, when they are closed by the rotary valve, they increase the combustion and pump chamber volume minimally. Their presence is not essential for the reduction of the effective length of stroke because they are only opened and kept open at times where injection of extra air is desired.

Because of the interaction of the injection ports with the rotary valves, engines with such may only be provided with the same number of ports and valves. This commonly results in the use of a single port.

Engines without rotary valves may be designed with a simpler construction. However, the injection ports have to be made lower because they reduce the effective length of stroke in the combustion chamber. This combined with the volume of their supply ducts reduces the extent of the compression that may be achieved in the pump chamber.

The latter is not important since the drawbacks can be countered by reducing the volume in the receivers. The former can be countered by a lower overall height. To a certain extent this can be countered by increasing the number of injection ports, which is possible in engines without rotary valves.

As in two-stroke engines with scavenging ports, four-stroke engines with injection ducts have to be given piston rings that are secured against turning in their annular fastenings. Therefore, they engage the port apertures with their ends.

The circumferential division of the cylinder wall by port apertures is performed so about 25% of the cylinder wall remains circumferentially, evenly distributed to support the piston rings.

Regardless of the kind of receiver used to regulate the compression in the pump chamber a throttle valve may be inserted in the engine intake to the pump chamber so that a further adjusting of the quantity of air amount sucked in may be performed.

FIG. 4 is a sketch showing how a four-stroke engine with a pump arrangement of its own, but without a rotary valve, can be provided fresh air at the initiation of the exhaust stroke and extra fresh air at the termination or finishing of the intake stroke. This is accomplished through low injection ports disposed immediately over the piston top when the piston reverses in BDC.

Figure 5:
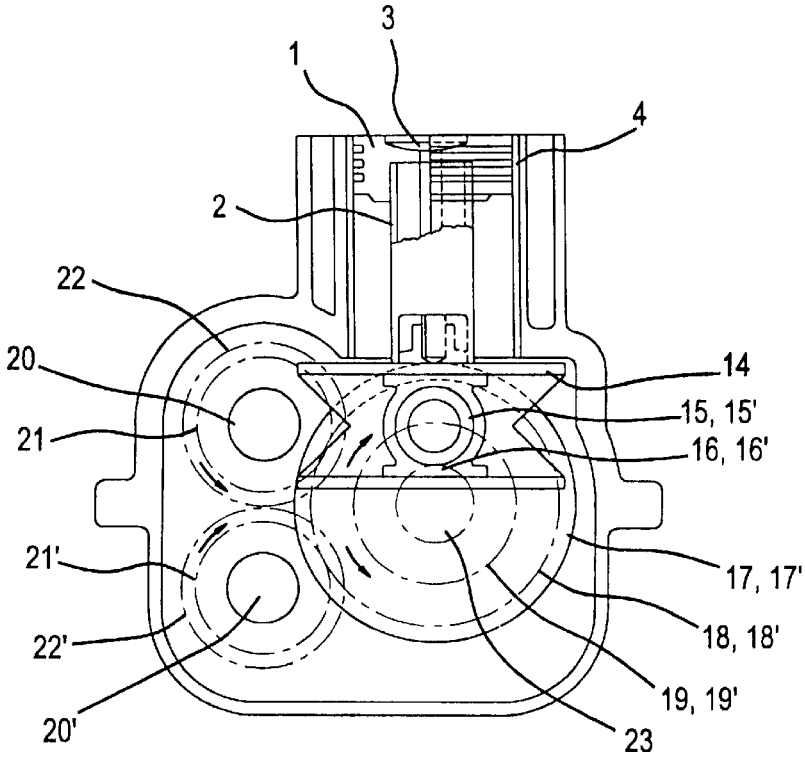
FIG. 5 is a cross-section view of the present crankshaft mechanism with an I-yoke with a compression chamber.

The engine in FIG. 4 is directly comparable with the engine in FIG. 5, which without injection ports functions as a traditional four-stroke engine.

In order to compare them mutually, both engines are drawn in the same scale and given the same piston diameter and length of stroke (quadratic engines). The force transformation mechanisms are identical, namely the I-yoke mechanism described in Danish patent application no. 1269/96 of Nov. 12 1996.

The numbering of constituent components on the sketch in FIG. 4 is the same as in FIG. 5 of patent application no. 1269/96. Disregard the numbers concerning components added to the sketch in order to explain their contributions for performing an air supply in addition to the one that may be achieved by intake through a valve arrangement common to four-stroke engines.

Compared with FIG. 5, the additions are the injection ports 5+5' and 5" with their associated supply ducts 6+6' and 6" connecting them with the very low space left of the pump chamber when the piston reverses in BDC. The space and supply ducts through a narrow, vertical connection 7 associating them with the active end of the annular chamber which, as it appears from the sectional view uppermost on the sketch, appears by inserting a preferably cylindrical spindle/tensile rod 9 in the centre axis of a cylindrical, tubular body extending past several combustion chambers, the rod 9 to be imparted a controlled axial movement by a regulating mechanism, e.g. a hydraulic cylinder, and hereby move the pistons 8, one in each regulating area, being fastened to the spindle/tensile rod which in the ends of the tubular body is passed through covers and inside the tube is passed through fastened partitioning walls 10 dividing the tube into the necessary number of regulating areas, one for each cylinder, which in the passive end is provided with borings 10 ensuring that atmospheric air may freely flow into and out from here by the movement of the pistons.

Furthermore, it appears from FIG. 4 that for establishing a pump chamber under the pistons 1 there is formed a bottom cooled by the engine cooling water and wherein a bushing 13 is placed to form a guide for the cylindrical piston rod 2, reciprocating exactly in the piston axis and at the same time with possible inserted packings seals off down against the underlying crank disc chamber shown on the sketch.

As shown in FIGS. 4 and 5, piston rod 2 is clamped to crosshead yoke 14. Crank pins 15, 15' are connected to crosshead slides 16, 16' and are positioned between crank pin discs 17, 17'. Gear wheels 18, 18' on gears 19, 19' attached to crank pin discs 17, 17' drive shafts 20, 20' through gears 21, 21' on gear wheels 22, 22'.

Insertion of the bottom piece with the sealing guide allows a small amount of oil to penetrate up. This causes pollution because it is supplied to the combustion chamber and absorbed in the air compressed in the pump chamber. At the same time, the good sealing down against the crank disc chamber combined with the pump chamber prevents combustion residues in penetrating into the crank disc chamber and polluting the oil used there. Thus it may be used for more running hours without causing wear on the components working in the crank disc chamber.

Because of its relatively large axial length, the sealing guide causes further secured guiding of the pistons at the reciprocation of these in the piston axis, so that the lateral pressure on the pistons already removed in practice is reduced. By selection of suitable materials for cylinder linings, pistons and piston rings make a lubrication free movement of the parts abutting on the cylinder wall conceivable, and at least makes possible that lesser contaminating lubricating agents may be used on a small scale.

Figure 6:
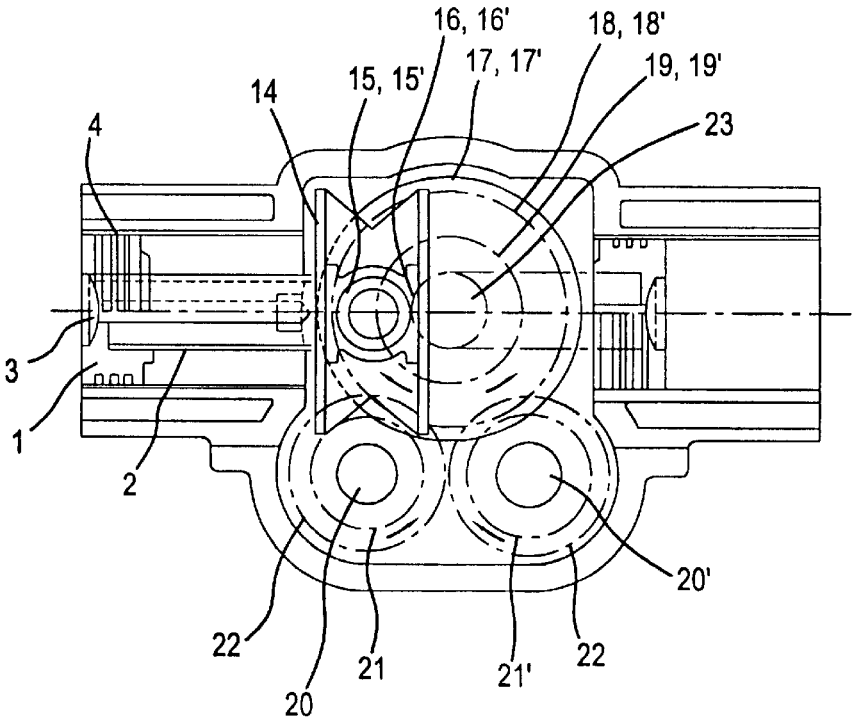
FIG. 6 is a cross-section view of the present crankshaft mechanism with opposed compressors.
Figure 7:
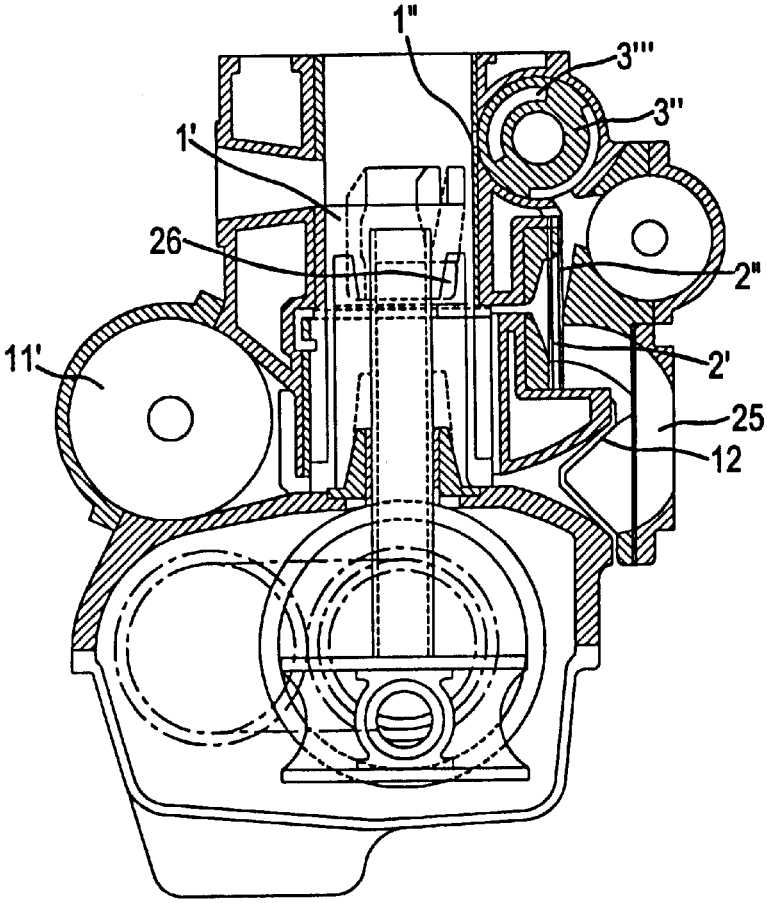
FIG. 7 is a cross-section view of a supercharged 2-stroke engine.

As engines with injection ports and I-yoke mechanisms, like the four-stroke engine sketched in FIG. 6, advantageously can be constructed with two pistons. The piston rods at each side of the I-yoke are fastened to this and thereby brought to work in the same common piston rod axis. The engines may be provided with two guides in this and hereby ensure guiding of the pistons such that they reciprocate exactly in their piston axis, whereby only their piston rings are pressed against the cylinder wall.

Four-stroke engines with injection ports, with and without rotary valves, can be made compact regardless of their embodiment. If, for example, the engine sketched in FIG. 8*c* is compared with the one shown in FIG. 5, it is seen that the engine in FIG. 4 only has an overall height which is increased with the axial height of the bottom cooled by the cooling water.

The comparison of the two sketched engines also shows that the engine in FIG. 4 has its piston rod extended, corresponding to the increase of the overall height. Because of the light piston rod construction the increase in overall height only causes a small increase in the reciprocating masses in the piston rod axis.

In order to estimate the size of the air amount supplied to an engine as outlined in FIG. 4, as supplement to the amount of air for both engines, aspirated through a traditional valve arrangement, the engines drawn in the scale 1:2 and rough calculations were performed.

The calculations showed that the Otto engine, according to FIG. 4, is supplied a supplementary amount of air which, depending on the adjusting of the receiver, is from 3.86% to 18.07%. This is greater than the amount supplied through the valve system. In the engine, made as diesel engine, a supplementary amount of air may be provided which is from about 6% to about 12%. This is greater than the amount supplied through the valve system.

Figure 8:
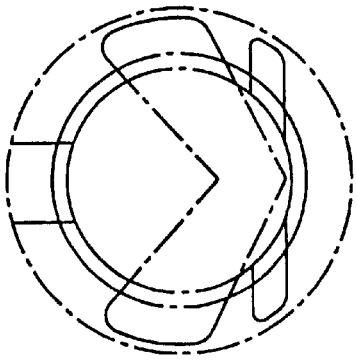
FIG. 8 is a cross-section view through the engine's exhaust and scavenging ports.

FIG. 8 is a cross-section view through the engine's exhaust and scavenging ports.

The double number of working cycles compared with the four-stroke engine increases the yield and the torque—but implies a strongly increased thermal load, especially on the piston.

This is countered in the present applicant's ("GV") invention. GV's two-stroke engine with ceramic coating of the piston top, injection of relatively cool charging air through aftercharge ports directed downward against the piston top, reduction of the lateral pressure on the piston by using the I-yoke force transmission mechanism, and coating of piston rings and piston sides with amorphous diamond which is scratch-proof, smooth and resistant up to 800° Celsius. Furthermore, heat is conducted away to a greater extent from the piston top to the pressure oil lubricated "crank disc chamber" by filling sodium into the light cylindrical piston rod while at the same time the rather long piston skirt at its external side during the working stroke of the piston is cooled by cool charging air freshly sucked in. During the compression stroke of the piston, it is cooled internally by cool scavenging air freshly sucked in.

Difficulties exist in making catalysts that may tolerate the double number of exhausts, which in addition are hotter than achieved by four-stroke engines. The worst problem is the supply of residues having incompletely combusted lubricating oil as it occurs in engines with crank case compression.

These problems are resolved in GV's two-stroke engine by letting scavenging as well as charging air be sucked in and compressed in pump chambers separated from the pressure oil lubricated "crank disc chamber" and by reducing/removing the need for lubrication by relieving the piston of lateral pressure and instead substituting it with a coating with amorphous diamond. This coating may be applied at room temperature without risk of deformation stresses.

What really has checked the interest for developing two-stroke engines with port control of scavenging as well as exhaust was the limits for exhaust pollution as in force from the year 2001.

Ford terminated their tests with the port controlled Ford-Orbital two-stroke engine. Toyota continued their tests with a petrol two-stroke with scavenging ports and whole 4 top-disposed exhaust valves. Mercedes-Benz continued their experiments with a diesel two-stroke without ports, but with 2 intake and 2 exhaust valves placed at the top. Both engines were troubled by the increased load of doubling the strokes compared with a four-stroke engine. Besides, it is just as complicated and costly to produce as four-stroke engines and has added costs of providing air compressors for yield reasons.

GV's two-stroke engine is basically provided with a simple and cheap port control with improved scavenging due to an increased scavenging air volume and due to operating with oil-less scavenging air. The basic port control is amplified with a simple and cheap arrangement of aftercharge air ports, the opening and closing of which is governed by an uncomplicated and cheap rotary valve with a simple duct design leading the access of the charge air previously compressed and accumulated in a receiver to the aftercharge ports.

GV's two-stroke engine works without use of costly turbos or compressors, in addition, regardless of the cylinder number it is computer controlled capable of providing itself with aftercharge air with a volume suitable for the momentary rpm and load of the engine, which minimises the pump work.

The pump work and the internal flow losses are minimised because the engine has been provided with very short and, to the greatest extent, straight intake and supply ducts. The internal friction losses are minimised as well because moving components are coated with durable and latest developed "Super-Slick" materials.

Most important: The reduction of the pollution problems for four-stroke engines will, as shown by CMCR, Australia, be made possible by the use of a force transformation mechanism which causes a harmonic carrying through of piston motion in combination with a direct and adjustable fuel injection, which primarily reduces the CO-number. CMCR has ascertained that a valve system enhancing the "swirling" between piston top and the cylinder head reduces the $NO_x$-number.

As accepted by Dr. Ing. Spencer Sorenson, DTU (Technical University of Denmark), during a meeting held at DTU on April 28 1999, this indicates that the CO-number could be attained by the controlled aftercharge suggested by GV, performed in a two-stroke engine with harmonic piston motion and a graduated direct fuel injection as indicated used in GV's two-stroke engine. However, the $NO_x$-number, which Spencer Sorenson pointed out to be a weighty factor in pollution connection, could not be improved thereby.

Simulation Confirms $NO_x$ Advantage

The expected advantage of lower $NO_x$ emissions achievable with the sinusoidal piston motion inherent with SYTech engines has been confirmed with the combustion simulation program developed at Melbourne University and CMCR. The existing program had been extended to include turbulence created by squish between piston and cylinder head. Further experimental work will be done to quantify the influence of the sinusoidal piston motion on $NO_x$ emissions.

This message from CMCR clarifies that the $NO_x$ number can be expected to be reduced by designing the aftercharge ports in my two-stroke engine (also in four-stroke engines) with both downward directed and tangentially inserted, possibly mutually oppositely phased and thus achieving an efficient "swirling" between the piston top and the cylinder head.

If continued development work hand in hand with research could demonstrate this, my two-stroke engine will be the ultimate solution to the greatest disadvantages of this type of engine.

What is claimed is:

1. A piston machine comprising a piston disposed in a cylinder, a working chamber formed by the piston and the cylinder, a pump comprising at least one pump chamber connected to the cylinder, the cylinder comprising plural injection ports including a first injection port and a second injection port, the second injection port disposed in a wall of the cylinder, a receiver connected to the pump chamber by the second injection port, said piston machine having only one piston in every cylinder, a suction valve on the piston machine, a supply system for supplying charges to the piston machine wherein the piston by reciprocation sucks in the charges, wherein at least one of the charges is a supplementary aftercharge to the charges supplied at the suction valve, the supply system being coupled to the working chamber of the piston, the charges being supplied by being blown through said first injection port on the wall of the cylinder, the first injection port being positioned proximal to a position of a piston top of the piston when the piston is at a bottom dead point and at said position the first injection port is completely exposed by the piston top, an exhaust duct, an annular duct connecting the plural injection ports and the exhaust duct to a dead volume of the pump for compressing and minimizing the supplementary aftercharge, the receiver being coupled to the exhaust duct, a differential pressure controlled check valve disposed in the exhaust duct proximal the dead volume of the pump, wherein the receiver comprises a device for adjusting a volume of the receiver such that an individual volume of the receiver is increased or reduced by adjustment of the device.

2. The piston machine of claim 1, wherein the supply system comprises a scavenging port.

3. The piston machine of claim 1, wherein the machine is a multi-cylinder machine comprising plural cylinders and the receiver comprises plural receivers, wherein the receivers are provided in the multi-cylinder machine corresponding to the cylinders, wherein the cylinders and the receivers are disposed along a similar axis, an adjusting system for adjusting the cylinders and the receivers attaining an exact same volume and for adjusting the machine to generate a charging pressure suitable for the machine to operate within a predetermined rpm and load range.

4. The piston machine of claim 3, further comprising the receivers being coupled to microprocessors, the receivers functioning as pressure regulators when the microprocessors control operations of the receivers by registering demands on the machine and by automatically adjusting up or down the volume thereby increasing the dead volume of each pump chamber, a suction duct on the machine having no throttling mechanism associated therewith, wherein the pressure regulators limit the charge flowing to the pump in conjunction with the suction duct and regulate charging pressures built up in the pump by compression thereby advancing and injecting the supplementary aftercharging.

5. The piston machine of claim 1, further comprising a crank-connecting rod mechanism for force transformation and a step piston with a piston skirt and a piston crown forming the pump chamber, wherein a diameter of the piston skirt is less than a diameter of the piston crown, the piston crown closing off against a working chamber above the pump chamber, and wherein the larger diameter piston crown closes down against an underlying, annular pump chamber formed by a difference in the diameters of the piston skirt and the wall of the cylinder, wherein the piston skirt extends through a bottom of the cylinder and reciprocates in the cylinder and seals down against an underlying crank chamber.

6. The piston machine of claim 1, further comprising a crank and connecting rod mechanism for force transformation and a stepped piston with a piston crown and a piston skirt forming the pump chamber, the piston crown sealing against a working chamber above the pump chamber, the piston skirt having a bottom edge and an outward collaring at the bottom edge, wherein an underside of the outward collaring seals against an underlying crank chamber of the machine and at an upward facing side edge seals against an annular pump chamber formed between the piston skirt and the pump cylinder.

7. The piston machine of claim 1, wherein the piston is a cylindrical piston and wherein pump chamber is annular and formed between the cylindrical piston without stepping, the cylinder and a projecting, hollow cylindrical piston rod connected rigidly with the piston, and a cylinder bottom piece with a combined sealing and guide bushing disposed at a center of the pump chamber, the piston rod being passed down into an underlying pressure oil lubricated crank disc chamber and attached to a yoke extending perpendicularly to the piston rod and forming part of a force transforming yoke mechanism for transforming a reciprocation of the piston to rotation or the reverse.

8. The piston of claim 7, wherein the yoke mechanism is a scotch-yoke mechanism or an I-yoke mechanism.

9. The piston machine of claim 1, wherein the piston is a stepped piston with a receiver arrangement and having a yoke mechanism for avoiding lubrication.

10. The piston machine of claim 9, wherein the yoke mechanism is a scotch-yoke mechanism or an I-yoke mechanism.

11. The piston machine according to claim 1, wherein the piston machine comprises a two-stroke or a four-stroke engine comprising a receiver arrangement disposed between an automatically controlled receiver, a combined receiver and pressure regulator, and a rotary valve disposed in the injection ports, wherein a rotation of the rotary valve is synchronized to follow a first rpm of the engine and is geared to rotate with a second rpm being same as or half of the first rpm, and comprising a duct system extending on a cylindrical periphery of a rotor.

12. The piston machine of claim 1, wherein the piston machine comprises a two-stroke engine with a receiver and rotary valve arrangement with a rotary valve synchronized to rotate with a same rpm as an rpm of the engine, and wherein the plural ports further comprise scavenging and exhaust ports, and wherein the rotary valve comprises a duct system with a large cross-section.

13. The piston machine of claim 1, wherein the piston machine comprises a two-stroke engine with a rotary valve comprising several injection ports disposed in a location in a combustion chamber of the engine and mutually connected with a connecting duct situated in the wall of the cylinder or on external side of a cylinder lining and being associated with a rotary valve placed therebetween and the receiver forming an intermediate storage for the charge.

14. The piston machine of claim 1, wherein the piston machine comprises a four-stroke engine with a receiver and rotary valve arrangement with a rotary valve synchronized to rotate with an rpm half of an rpm of the engine, and a rotor comprising one or more ducts.

15. The piston machine of claim 1, further comprising plural cylinders, rotary valves disposed on a common shaft polarly angularly turned relative to a functioning of each valve for each cylinder, such that the functioning is performed in relation to a piston reciprocation in each cylinder when the common shaft is rotated with an rpm adjusted to an intended function and is driven independently from a crank disc shaft of the machine, and a displacing mechanism centrifugally controlled by mechanical, hydraulic, or electronic means for a relative turning between a rotor shaft and a driving wheel.

16. The piston machine of claim 1, wherein the piston machine comprises a working chamber and two pump chambers formed by an interaction between the piston and the cylinder, wherein the piston is associated with a force transformation mechanism and the cylinder has a bottom part with a combined sealing and guide bushing provided for passing through of a piston rod thereby forming a further pump chamber along with the pump chamber formed at an outward collaring of the piston, wherein the two pump chambers function as a two-stroke engine or as a three-stage compressor.

17. The piston machine of claim 16, wherein the transformation mechanism is a scotch-yoke mechanism or an I-yoke mechanism.

18. The piston machine of claim 1, wherein the piston machine comprises a two-stroke engine comprising a scavenging air pump having a first intake opening and a charge pump having a second intake opening.

19. The piston machine of claim 18, wherein the two-stroke engine comprises one or more duct connections extending from a dead volume of the charge pump, the duct connections reaching the piston close to a top dead point by circumventing a collaring of short-circuits of the piston between the dead volume of the charge pump and a chamber of the scavenging air pump.

20. The piston machine of claim 1, wherein the piston machine comprises a three-stage compressor having three pump chambers.

21. The piston machine of claim 1, further comprising a yoke mechanism comprising a light-weight hollow cylindrical piston rod in the piston for enhancing heat conduction away from the piston and having a filling of sodium with a low melting point for forming a liquid due to reciprocation of the piston and the piston rod moving reciprocally in the piston.

22. The piston machine of claim 21, wherein the yoke mechanism is a scotch-yoke mechanism or an I-yoke mechanism.

* * * * *